US007290314B2

(12) United States Patent
Vuillaume et al.

(10) Patent No.: US 7,290,314 B2
(45) Date of Patent: Nov. 6, 2007

(54) METHOD FOR PRODUCING A COMPLEX NONWOVEN FABRIC AND RESULTING NOVEL FABRIC

(75) Inventors: Andre Vuillaume, Biviers (FR); Frederic Noelle, Saint Nazaire les Eymes (FR)

(73) Assignee: Rieter Perfojet, Montbonnot (FR)

( * ) Notice: Subject to any disclaimer, the term of this patent is extended or adjusted under 35 U.S.C. 154(b) by 451 days.

(21) Appl. No.: 11/053,191

(22) Filed: Feb. 8, 2005

(65) Prior Publication Data

US 2005/0188513 A1 Sep. 1, 2005

Related U.S. Application Data

(63) Continuation-in-part of application No. 10/184,544, filed on Jun. 28, 2002, now abandoned, which is a continuation of application No. PCT/FR00/03188, filed on Nov. 16, 2000.

(30) Foreign Application Priority Data

Jan. 11, 2000 (FR) ..... 00 00298

(51) Int. Cl.
*D04H 5/02* (2006.01)

(52) U.S. Cl. ..... 28/104

(58) Field of Classification Search ..... 28/104, 28/105, 167, 106, 103; 442/408, 412, 413, 442/384, 385, 387
See application file for complete search history.

(56) References Cited

U.S. PATENT DOCUMENTS 3,493,462 A * 2/1970 Bunting, Jr. et al. ..... 28/105
3,508,308 A 4/1970 Bunting, Jr. et al. ..... 28/72.2
4,287,251 A 9/1981 King et al. ..... 428/198
4,808,467 A * 2/1989 Suskind et al. ..... 28/104
4,879,170 A 11/1989 Radwanski et al. ..... 428/233
4,931,355 A * 6/1990 Radwanski et al. ..... 28/104
5,023,130 A * 6/1991 Simpson et al. ..... 28/104
5,290,628 A * 3/1994 Lim et al. ..... 28/104
5,587,225 A 12/1996 Griesbach et al. ..... 428/198
5,801,107 A 9/1998 Everhart et al. ..... 442/408
6,110,848 A 8/2000 Bouchette ..... 442/384

(Continued)

FOREIGN PATENT DOCUMENTS

EP 0 423 619 A1 1/1991

(Continued)

*Primary Examiner*—Amy B. Vanatta
(74) *Attorney, Agent, or Firm*—Heslin Rothenberg Farley & Mesiti P.C.; Victor A. Cardona, Esq.

(57) ABSTRACT

The invention concerns a method for producing a complex nonwoven fabric which consists in continuously producing a complex wherein a first web of a cellulosic fibres is continuously sandwiched between two webs of spunbonded filaments, and which consists in: producing a first web of spunbonded filaments, the bundle of extruded and drawn filaments being received on a mobile conveyor belt in the form of a non-bonded lap; depositing on said web by airlaid process a second web of cellulosic fibres; depositing on the textile web a second web of non-bonded continuous filaments; transferring the resulting complex onto an installation for water-jet bonding and hydro-entanglement consolidation; and in drying the nonwoven mixed product and then recuperating it, for example in the form of a cloth wind-up.

9 Claims, 1 Drawing Sheet

U.S. PATENT DOCUMENTS

| | | | | |
|---|---|---|---|---|
| 6,177,370 | B1 | 1/2001 | Skoog et al. | 387/442 |
| 6,903,034 | B1 * | 6/2005 | Putnam et al. | 442/408 |
| 2005/0215156 | A1 * | 9/2005 | Ferencz et al. | 442/408 |

FOREIGN PATENT DOCUMENTS

| | | |
|---|---|---|
| EP | 0 333 209 B1 | 6/1994 |
| EP | 0 992 338 A1 | 4/2000 |
| WO | WO99/00244 | 1/1999 |

* cited by examiner

METHOD FOR PRODUCING A COMPLEX NONWOVEN FABRIC AND RESULTING NOVEL FABRIC

CROSS-REFERENCE TO RELATED APPLICATIONS

This application is a Continuation-In-Part of U.S. Ser. No. 10/184,544, filed Jun. 28, 2002 now abandoned, which is a Continuation of International Application No. PCT/FR00/03188, filed on Nov. 16, 2000, published in French on Jul. 19, 2001, as WO 00/51693, and which claims priority from French patent application 00.00298, filed on Jan. 11, 2000, the entire disclosures of which are incorporated herein by reference.

TECHNICAL FIELD

For decades, it has been proposed to replace conventional textile webs (wovens and knits) with structures called "nonwovens".

In general, such nonwoven structures can be classified in three broad categories, resulting from their actual manufacturing process, namely nonwovens produced by a so-called "dry process", these being formed by carding and/or the airlaid technique, nonwovens obtained by the "melt route", which technique is usually referred to by the expression "spunbond", and the technique called "wet process" derived from papermaking techniques.

Moreover, it has been known for a very long time that it is possible to adapt the final properties of the product obtained by producing mixtures of materials, for example by combining together webs consisting of fibers of different type, for example natural, artificial or synthetic fibers.

The invention provides a novel method making it possible to produce such a type of nonwoven article consisting of a mixture of fibers of different type, which nonwoven will, in the rest of the description, be referred to by the expression "hybrid nonwoven" or "composite nonwoven".

PRIOR ART

Very many proposals have been made hitherto for producing hybrid or composite nonwovens by combining together webs of artificial or synthetic fibers with a web of cellulosic fibers. The various constituents may be combined in various ways, for example by means of bonding techniques—mechanical needle bonding or hydro-entanglement—the latter technique, known for a very long time, being described for example in U.S. Pat. No. 3,508,308. In particular, this document describes the production of hybrid webs produced by the airlaid technique by intimately mixing fibers, for example mixing synthetic (polyester or acrylic) fibers with rayon fibers (see examples 10 and 11). It also describes (see examples 12 and 13) the production of complexes having a central ply consisting of continuous filaments and two outer plies based on fibers, especially polyester fibers, which are distributed by the airlaid technique, the various plies being bonded together by the action of fluid jets.

It has also been proposed, as indicated in EP 423 619, to produce absorbent fabrics by combining, again by means of water jets, a web consisting of continuous filaments with a web consisting of a mixture of cellulosic fibers, especially wood fibers.

Finally, it is known to produce nonwovens by sandwiching a lap of fibers between two webs of continuous filaments already consolidated by hot calendering, the final bonding of the various plies also being provided by the action of water jets.

The latter relatively simple processing technique has many major drawbacks, namely:

- the fact that the webs of continuous (spunbond) filaments have already been consolidated by a calendering heat treatment prevents intimate mixing of these filaments with the wood fibers of the airlaid web, which reduces the absorptivity of the complex and also results in the formation of a product which is rough and lacking in flexibility;
- moreover, it is necessary, in order to ensure satisfactory cohesion between the plies and prevent delamination of the complex, to use, during the water-jet consolidation phase, very high fluid velocities, since the calendering points of the spunbond webs prevent any mobility of the synthetic filaments; these high water-jet velocities incur an extra energy consumption cost and a greater loss of cellulosic fiber;
- the points of bonding between the filaments obtained by calendering may represent up to 20 to 25% of the area of the spunbond-based webs and therefore constitute an equivalent amount of obstacles to the passage of the water jets;
- finally, the fact that the continuous filaments of the webs cannot move makes the material very stiff, it losing its textile properties and being more like a paper than a true textile.

SUMMARY OF THE INVENTION

An improved method has now been found, and it is this which forms the subject of the present invention, which allows the continuous production of perfectly bonded hybrid nonwovens exhibiting high mechanical properties while retaining the appearance, handle and flexibility of a conventional textile, such as a woven.

Such a problem is solved by combining, in a very precise way, techniques of the prior art used continuously and under very precise conditions, namely:

- the techniques for producing nonwoven webs made from short fibers, which are distributed by the airlaid technique;
- the techniques for producing spunbond webs; and
- consolidation of the complex formed by the action of water jets.

In general, the method according to the invention consists in continuously producing a complex in which a fibrous web based on cellulosic fibers is sandwiched between two webs of continuous filaments, which method consists:

- in producing a first web of continuous filaments, the bundle of extruded and drawn continuous filaments being taken up on a moving conveyor belt in the form of a nonbonded lap;
- in depositing on this web, by the airlaid technique, a second web of cellulosic fibers;
- in depositing on the fibrous web a second web of nonbonded continuous filaments;
- in transferring the complex formed onto a water-jet bonding unit and in consolidating the assembly by hydro-entanglement; and
- in drying the hybrid nonwoven produced and then taking it up, for example in the form of a wound package.

According to a preferred way of implementing the method according to the invention, the cellulosic fibers used in the production of the complex are wood fibers and they are deposited by pneumatic layering.

Moreover, if it is conceivable to carry out only a single water-jet bonding treatment, the complex formed is preferably subjected to two successive treatments acting against the two opposed sides of the complex.

The invention also relates to a novel type of nonwoven product obtained by implementing this method.

Such a hybrid nonwoven, which therefore consists of a mixture of fibers of different type, is characterized in that it is composed of a ply of natural fibers, especially wood fibers, trapped between two nonwoven webs consisting of extruded and drawn filaments, based on a synthetic material, the cohesion of the various plies being obtained by entanglement thanks to the action of water jets.

BRIEF DESCRIPTION OF THE DRAWINGS

The invention and the advantages which stem therefrom will, however, be more clearly understood from the illustrative examples which follow, given below by way of indication but implying no limitation, and which are illustrated by the appended drawings in which:

FIGS. 1*a*, 1*b*, 1*c* and 1*d* are enlarged views of the regions circled in this FIG. 1.

MANNER OF REALIZING THE INVENTION

Figure 1:
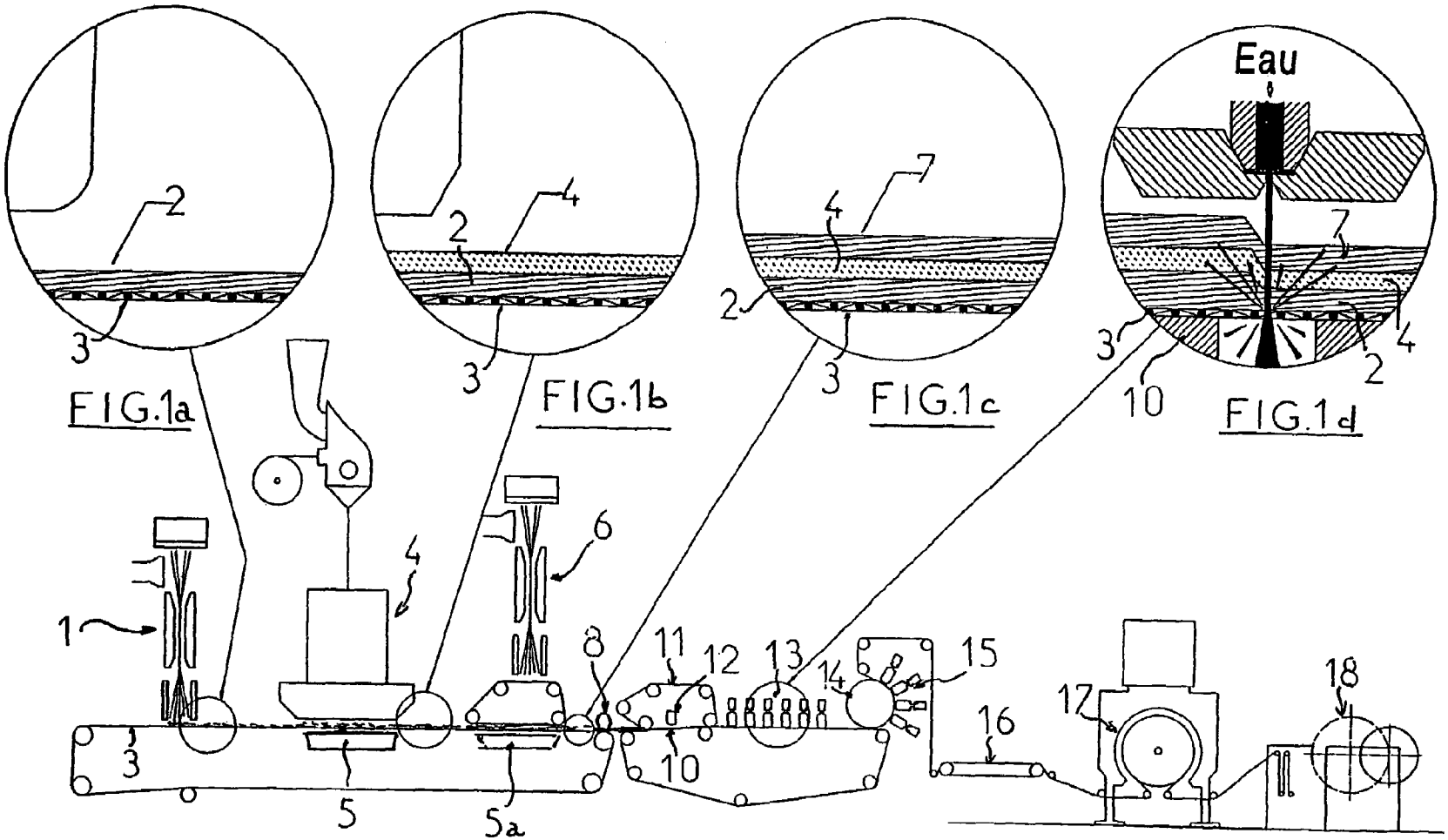
FIG. 1 is a schematic view of an entire line for producing a complex fabric produced in accordance with the method according to the invention.

A composite nonwoven is produced continuously on a production line, like that illustrated in FIG. 1.

To do this, a first web (2) of continuous filaments is produced by means of a production unit, denoted by the general reference (1), by melting, spinning and drawing, which filaments are deposited and distributed over a moving conveyor belt (3).

Optionally, immediately after formation, this first web (2) may be subjected to a compacting operation by means of a press roll or by the action of jets coming from a rail of water injectors. To obtain such a compacting operation via water jets from a rail of water injectors, the water jet pressure should be between about 10 to about 15 bars, and most preferably about 12 bars. Also, the diameter of the water jets should be between about 80 μm to about 140 μm, most preferably about 100 μm. The number of rows of jets should be between about 1-3, most preferably 1. The gap between such jets should be between about 0.5 millimeters to about 0.9 millimeters. As will be evident to one skilled in the art, the pressure used for such a compacting operation is lower than in "aperturing" which utilizes jets of water at high pressure, i.e., normally more than 100 bars.

The continuous filaments of this first web (2) may be based on a polymer consisting of polypropylene, polyester or other synthetic materials, such as a polyethylene or polyamide, this list not being exhaustive. Optionally, the continuous filaments may consist of what are called "bicomponent" filaments, such as those obtained by the coextrusion of polypropylene and polyethylene.

The web (2) of nonbonded continuous filaments is then transferred under a unit, denoted by the general reference (4), which, by the airlaid technique, allows discontinuous fibers (4), of another type, and more particularly cellulosic, especially wood, fibers, to be deposited on the surface of the first web (2).

The cellulosic fibers are deposited on the surface of the first web (2) by means of a stream of air. Preferably, the filamentary web (2) is held in place on the conveyor belt (3) by means of a suction unit (5). Thereafter, said fibers (4) are preferably deposited between the nonbonded filaments of the web (2) by the effect of the suction, thus allowing excellent integration of the two constituents.

The complex (2, 4) which is still held in place supported by the conveyor belt (3) is then taken under a second zone (6) for forming a second web (7) of continuous filaments, these also being synthetic filaments, of the same type as or of a different type from those of the first web (2).

A press roll (8) is preferably placed after this zone for depositing the web (7) and makes it possible to compact the assembly for the purpose of transferring it to the water-jet bonding unit, denoted by the general reference (9), which follows the production line.

Optionally, this compacting operation could be carried out by means of a rail of water injectors.

The complex is then introduced into the water-bonding zone (9) on a conveyor (10) on which are carried out, in succession, the operations of compacting and prewetting the assembly by means of an upper conveyor (11) tangential to the lower conveyor (10), and within which a water injector (12) is placed.

After the complex has been compacted and prewetted, it is subjected to the action of a succession of water jets (13) delivered by several water injectors placed in series.

These water jets (13) consolidate the assembly consisting of the various plies of the complex and give the upper ply good abrasion resistance.

The structure thus treated is then transferred, by being turned upside down, onto a cylinder (14), or onto another conveyor, associated with several injectors (15) which also deliver water jets onto the other side of the complex, thus reinforcing the consolidation of the assembly of plies, while giving the ply facing the jets good abrasion resistance.

The complex thus obtained is then transferred onto an expressing conveyor (16) on which it is expressed by means of a suction box connected to a vacuum generator.

It is then dried by means of a traversing air cylinder (17) and then taken up in a conventional manner, for example in the form of a wound package (18).

EXAMPLE

A product in accordance with the invention is produced in the following way.

A web (2) of continuous filaments, weighing 15 g/m$^2$, is produced on a unit sold by the Applicant under the name "spunjet", which allows a nonwoven web to be produced by extrusion, drawing and distribution of continuous filaments.

In this embodiment, as polymer, polypropylene such as that sold by Amoco under the reference 100 ZA 35 is extruded.

The web formed consists of 7000 filaments per meter of width and is produced at a rate of 250 meters per minute. The diameter of the filaments after drawing is about 15 microns.

A suction unit placed opposite the drawing slit (20) allows precise control of the way in which the filament is deposited on the conveyor belt (3) and of its uniformity thereover.

Placed above the same conveyor (3) is a unit (4) for distributing, by the airlaid technique, discontinuous fibers over the web (2) formed beforehand.

Such a fiber-distributing unit may consist of a conventional unit such as that sold by M & J.

In the specific example, 35 g/m$^2$ of cellulosic fibers, and more particularly wood fibers, sold by Korsnaes, were deposited on the spunbond web (2), these wood fibers, with a length of around 3 mm, being usually referred to by the expression "fluff pulp".

A suction box (5) is placed beneath the conveyor under the entire surface of the airlaid distributing head (4). This suction head (5) is connected to a vacuum generator which allows the wood fibers to be uniformly distributed while maintaining the homogeneity of the spunbond web (2).

A press roll (not shown), the speed of which is synchronized with said belt (3), compacts the assembly thus formed.

After compacting, a second spunbond web, weighing 15 g/m$^2$, of the same type as the first web (2) is deposited on the surface of the complex.

This web may be formed either on the same conveyor (3) or on a separate conveyor.

This web (7) is therefore distributed over the ply (4) of cellulosic fibers. Preferably, transfer takes place in a positive manner using a suction box (5*a*) placed beneath the main conveyor opposite the point of transfer.

The structure obtained, which weighs 65 g/m$^2$, is optionally compacted by means of a roller (8). This compacting may optionally be carried out by means of an additional rail of water injectors.

The complex is then transferred onto the conveyor (10) of the water-jet bonding unit (9).

Such a bonding unit comprises a main conveyor (10) above which is placed an upper conveyor (11) tangential to the latter, and inside which is placed a water injector (12) delivering 4000 jets of water per meter, these jets having a diameter of 130 microns and a velocity of 34 meters per second.

The sandwich thus compacted and wetted is treated on its topside by six water injectors (13), placed in series, which blast water jets 120 microns in diameter spaced apart by 0.6 mm with pressures between about 170 bars to about 220 bars resulting in water velocities of between about 123 meters per second to about 140 meters per second, respectively.

The treated complex is then transferred, by turning it over, onto a cylinder (14) around which are placed four water injectors (15) which blast water jets 120 microns in diameter spaced apart by 0.6 mm with pressures between about 170 bars to about 220 bars resulting in water velocities of between about 123 meters per second to about 140 meters per second, respectively.

The complex thus consolidated is transferred onto an expressing conveyor (16), on which it is expressed by a suction box in which there is a vacuum of 400 mbar.

The assembly is then dried at a temperature of 120° C. by a traversing air cylinder (17), and then taken up at (18).

It is observed that the product obtained at the end of the production line weighs about 60 g/m$^2$, exhibits excellent homogeneity, has a good handle and great pliancy, and excellent abrasion resistance both in the dry state and in the wet state.

It has a high water absorptivity, of around 850%.

Such a water absorptivity is comparable to that of hybrid nonwovens consisting of discontinuous fibers and produced by carding.

On the other hand, the abrasion resistance both in the dry state and in the wet state, together with the mechanical properties, are greatly superior.

Such a product is perfectly adapted to various applications, such as industrial or domestic wiping products, impregnated wipes and operating gowns and drapes, such applications being given by way of indication, but implying no limitation.

The invention claimed is:

1. A method for producing a complex nonwoven fabric which consists in continuously producing a complex in which a fibrous web based on cellulosic fibers is sandwiched between two webs of continuous filaments, the method comprising:

producing a first web of continuous filaments, wherein a bundle of extruded and drawn continuous filaments of the first web is received on a moving conveyor belt in the form of a nonbonded lap;

depositing on the first web, by the airlaid technique, a second web of cellulosic fibers;

depositing on the second web a third web of nonbonded continuous filaments wherein the depositing on the first web and the depositing on the second web forms a complex;

transferring the complex onto a water-jet bonding unit and consolidating the complex by hydro-entanglement; and drying the nonwoven produced by consolidating the complex and taking it up in the form of a wound package.

2. The method as claimed in claim 1, characterized in that the cellulosic fibers used in the production of the complex are wood fibers.

3. The method as claimed in claim 1 wherein the complex is subjected to two successive bonding treatments by water jets acting against the two opposed sides of said complex.

4. A method for producing a complex nonwoven fabric which consists in continuously producing a complex in which a fibrous web based on cellulosic fibers is sandwiched between two webs of continuous filaments, the method comprising:

producing a first web of continuous filaments, wherein a bundle of extruded and drawn continuous filaments of the first web is received on a moving conveyor belt in the form of a nonbonded lap;

compacting the first web;

depositing on the first web, by the airlaid technique, a second web of cellulosic fibers;

depositing on the second web a third web of nonbonded continuous filaments wherein the depositing on the first web and the depositing on the second web forms a complex;

transferring the complex onto a water-jet bonding unit and consolidating the complex by hydro-entanglement; and drying the nonwoven produced by consolidating the complex and taking it up in the form of a wound package.

5. The method of claim 4 wherein the compacting comprises compacting by applying a press roll to the first web.

6. The method of claim 4 wherein the compacting comprises compacting by applying a plurality of water jets to the first web.

7. The method of claim 6 wherein the plurality of water jets is applied at a low pressure.

8. The method of claim 7 wherein the plurality of water jets is applied at a pressure of between about 10 bars to about 15 bars.

9. The method of claim 8 wherein the plurality of water jets is applied at a pressure of about 12 bars.

* * * * *